US006177920B1

(12) United States Patent
Koyama et al.

(10) Patent No.: US 6,177,920 B1
(45) Date of Patent: Jan. 23, 2001

(54) ACTIVE MATRIX DISPLAY WITH SYNCHRONOUS UP/DOWN COUNTER AND ADDRESS DECODER USED TO CHANGE THE FORWARD OR BACKWARD DIRECTION OF SELECTING THE SIGNAL OR SCANNING LINES

(75) Inventors: Jun Koyama; Ritsuko Suzuki, both of Kanagawa (JP)

(73) Assignee: Semiconductor Energy Laboratory Co., Ltd. (JP)

( * ) Notice: Under 35 U.S.C. 154(b), the term of this patent shall be extended for 0 days.

(21) Appl. No.: 08/537,540

(22) Filed: Oct. 2, 1995

(30) Foreign Application Priority Data

Oct. 3, 1994 (JP) ..... 6-263097

(51) Int. Cl.[7] ..... G09G 3/36; G09G 5/00
(52) U.S. Cl. ..... 345/100; 345/204
(58) Field of Search ..... 345/89, 92, 100, 345/94, 77, 90, 104, 96, 97, 87, 95, 205, 99, 127, 58, 510, 516, 471, 198; 348/790; 358/518, 453, 409; 257/72

(56) References Cited

U.S. PATENT DOCUMENTS 4,122,494 * 10/1978 Levine ..... 358/409
4,465,999 * 8/1984 Tsuzuki et al. ..... 345/84
4,488,150 * 12/1984 Kanatani ..... 345/77
4,647,927 * 3/1987 Ichikawa et al. ..... 345/198
4,782,340 * 11/1988 Czubatyj et al. ..... 345/92
4,841,453 * 6/1989 Finlay et al. ..... 345/127
4,859,998 * 8/1989 Kawamura et al. ..... 345/89
5,017,914 * 5/1991 Uchida et al. ..... 345/89
5,119,083 * 6/1992 Fujisawa et al. ..... 345/510
5,151,876 9/1992 Ikeda .
5,157,386 * 10/1992 Uchida et al. ..... 345/89
5,166,670 * 11/1992 Takeda et al. ..... 345/100
5,233,446 * 8/1993 Inoue et al. ..... 345/95
5,241,304 * 8/1993 Munetsugu et al. ..... 345/98
5,253,093 * 10/1993 Takeda et al. ..... 345/100
5,307,084 * 4/1994 Yamaguchi et al. ..... 345/58
5,317,332 * 5/1994 Kanno et al. ..... 345/94
5,347,294 * 9/1994 Usui et al. ..... 345/89
5,369,417 * 11/1994 Takeda et al. ..... 345/100
5,434,599 * 7/1995 Hirai et al. ..... 345/100
5,465,102 * 11/1995 Usui et al. ..... 345/89
5,523,773 * 6/1996 Arakawa et al. ..... 345/98
5,530,266 * 6/1996 Yonehara et al. ..... 257/72
5,574,475 * 11/1996 Callahan, Jr. et al. ..... 345/100
5,583,532 * 12/1996 Watanabe ..... 345/94
5,610,627 * 3/1997 Inamori et al. ..... 345/99
5,616,936 * 4/1997 Misawa et al. ..... 345/99
5,739,803 * 4/1998 Neugebauer ..... 345/100
5,815,136 * 9/1998 Ikeda et al. ..... 345/100
5,990,857 * 11/1999 Kubota et al. ..... 345/100
6,011,535 * 1/2000 Katoh et al. ..... 345/100

FOREIGN PATENT DOCUMENTS 2-046490 2/1990 (JP) .
6-118904 4/1994 (JP) .

* cited by examiner

*Primary Examiner*—Steven J. Saras
*Assistant Examiner*—Paul A. Bell
(74) *Attorney, Agent, or Firm*—Cook, Alex, McFarron, Manzo, Cummings & Mehler, Ltd.

(57) ABSTRACT

In a signal line driver circuit for an active matrix type display device for performing a plurality of gradation displays, an output signal of a synchronous type clock counter is supplied as an address signal to an address decoder circuit through address lines. Gradation data is stored in latch circuits in accordance with the address signal used as latch pulse. In a synchronizing circuit, an output timing of the gradation data stored in the latch circuits is synchronized with a display scan timing. After the output gradation data is converted into an analog gradation voltage, the analog gradation voltage is applied to a pixel portion through an analog switch.

37 Claims, 9 Drawing Sheets

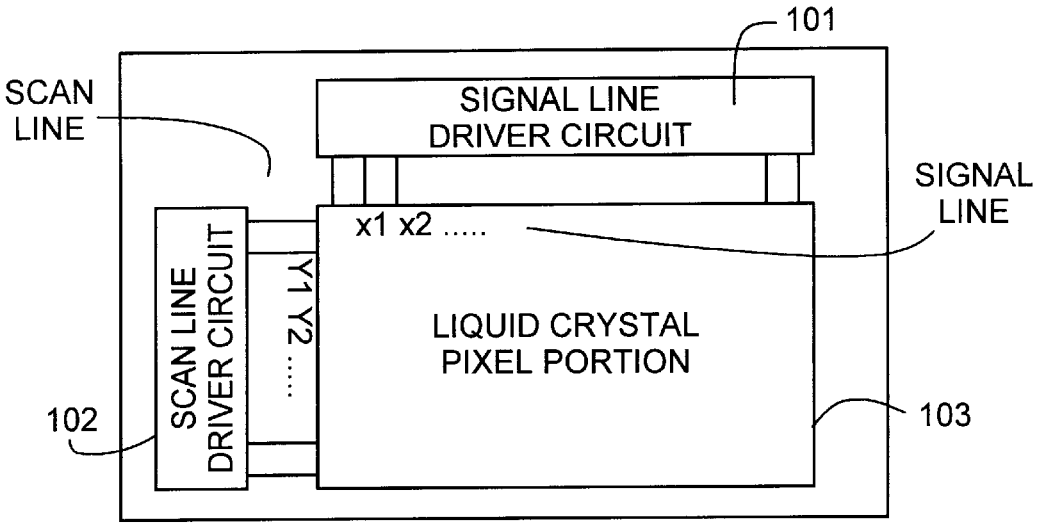
FIG.1
FIG.2
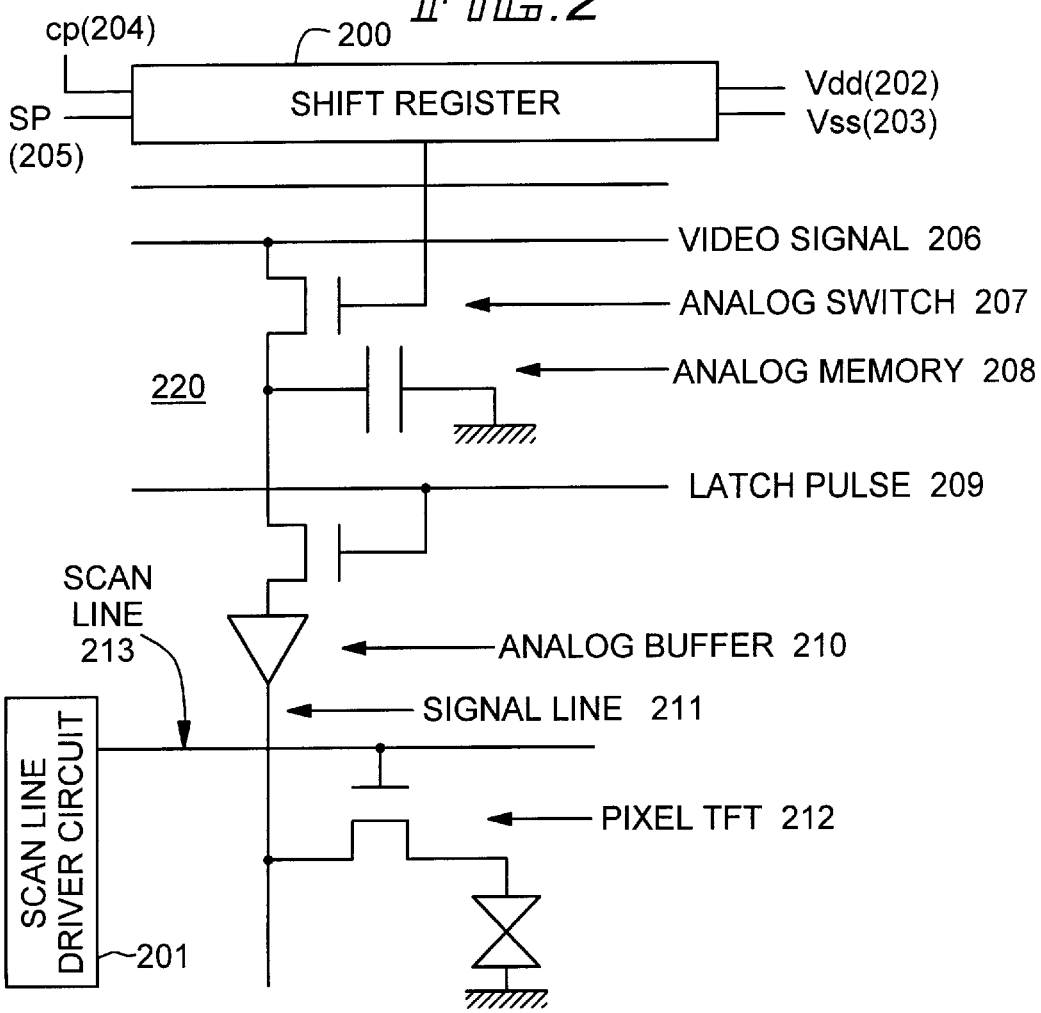

ACTIVE MATRIX DISPLAY WITH SYNCHRONOUS UP/DOWN COUNTER AND ADDRESS DECODER USED TO CHANGE THE FORWARD OR BACKWARD DIRECTION OF SELECTING THE SIGNAL OR SCANNING LINES

BACKGROUND OF THE INVENTION

The present invention relates to a driver circuit for a display device, and in particular, to a driver circuit suitable use in a liquid crystal display device.

Recently, a line sequential scanning circuit using a shift register has been mainly used as a driver circuit for a display device such as a liquid crystal display device of an active matrix type.

Gradation signals for providing a gradation display are classified into the digital system and the analog system. In both systems, a signal is input to registers which are connected in series by n-stages (n: the number of pixels in a horizontal direction or vertical direction) so as to be delayed and transmitted, thereby performing a line sequential scanning operation.

Each register is connected with a sample and hold circuit and a signal amplifying circuit, and a signal which has passed through those circuits is transmitted to a pixel portion through a signal line.

A schematic diagram of the overall liquid crystal display device is shown in FIG. 1.

A signal line driver circuit 101 and a scanning line driver circuit 102 are arranged on the same glass substrate, and a liquid crystal pixel portion 103 is disposed in the center portion of the display device.

The signal line driver circuit 101 and the liquidcrystal pixel portion 103 are connected to each other through vertical signal lines X1, X2, . . . , whereas the scanning line driver circuit 102 and the liquid crystal pixel portion 103 are connected to each other through horizontal scanning lines Y1, Y2, . . . Thin film transistors (TFTs) as switching elements are disposed on the respective intersections of the signal lines and the scanning lines in the form of a matrix.

A source electrode of the TFT is connected to the signal line, a gate electrode thereof is connected to the scanning line thereof, and a drain electrode thereof is connected to a pixel electrode of the liquid crystal pixel portion 103. The pixel electrode is opposed to a counter electrode through the liquid crystal.

Signals are transmitted from the scanning line driver circuit 102 to the liquid crystal pixel portion 103 through the scanning lines Y1, Y2, . . . in synchronism with a timing at which the signal lines X1, X2, . . . are sequentially driven by the signal line driver circuit 101, thereby providing a signal necessary for image display.

An example of the line sequential driver circuit of the analog system type is shown in FIG. 2. In FIG. 2, numeral 220 is a signal line driver circuit, and numeral 201 is a scanning line driver circuit.

In the signal line driver circuit 201, a shift register 200 is connected with a source voltage Vdd 202, Vss 203 and a clock pulse CP 204, and an input start pulse SP 205 is delayed by and transmitted through flip-flop circuits (F.F. circuits) connected in series inside thereof.

The outputs of the shift registers 200 constructed by n-stage serial connections are Q0, Q1, . . . Qn. Using those outputs as a timing signal, a video signal 206 is output to a sampling circuit (not shown) through an analog switch 207.

In the sampling circuit, gradation data is sampled. Sampled analog gradation data is stored in an analog memory 208, which constitutes a sample and hold circuit, once before the data is input to a pixel portion.

In accordance with a scanning timing due to a latch pulse 209 input from the external, the analog gradation data stored in the analog memory 208 is subjected to an impedance conversion by an analog buffer 210 before the data is transmitted to a pixel portion 212 through a signal line 211.

The above path is obtained through the shift register 200 at each stage so that the image line sequential scanning operation is conducted.

In this example, the line sequential scanning driver circuit of the analog system is described. In the digital system, the analog memory 208 is replaced by a latch circuit for storing the gradation data.

However, in any of the analog or digital systems, since the line sequential scanning operation is conducted using a shift register, if there exists even one defective circuit in the shift register connected by a plurality of stages, a signal is not transmitted to the registers which are arranged at-the stages subsequent to the stage where the defective circuit exists. As a result, an excellent display state cannot be obtained, and yield for the display device is lowered.

In a general projection type display device, represented by a liquid crystal projector shown in FIG. 4, three liquid crystal light valves 401, 402 and 403 for R (red), G (green) and B (blue) are independently used in the three plate type. A light irradiated from a lamp is polarized by a polarizing prism and separated into red polarization, green polarization and blue polarization by a dichroic mirror. While the light is separated, a red polarization component, a green polarization component, and a blue polarization component are incident to a red liquid crystal panel, a green liquid crystal panel, and a blue liquid crystal panel, through a projection lens, respectively.

In this situation, after passing through the light valves 401, 402 and 403, the green polarization component and the blue polarization component are reversed an even number of times by a reflecting mirror while the red polarization component is reversed an odd number of times. Consequently, since a red image must be finally reversed, a selection direction of the scanning lines (or signal lines) for red images in a driver circuit must be reversed to that for green and blue images.

In the general driver circuit, one scanning line driver circuit is disposed on the display device side. For example, in FIG. 5A, in order to conduct the backward selection of the scanning lines, a scanning line driver circuit for a forward selection may be disposed on one side of the liquid crystal pixel portion, whereas a scanning line driver circuit for a backward selection may be disposed on an opposite side thereof. Alternatively, in FIG. 5B, a scanning line driver circuit for the forward selection as well as a scanning line driver circuit for the backward selection is disposed on one side of the liquid crystal pixel portion. With those arrangements, a bi-directional driver circuit is constructed.

Compared with the manufacture of two kinds of display devices for the forward and backward selections, the above arrangement does not require two kinds of masks for manufacturing, and does not increase the manufacturing steps, thereby being capable of lowering the costs. However, since the number of drive circuits are increased, the display device per se cannot be prevented from becoming large in size. Also, the frequency of the defects is increased, which a significant factor that causes the yield to be lowered.

In the conventional line sequential scanning of the delay signal transmission system using the shift register, one defective circuit causes a signal not to be transmitted to the succeeding circuit thereby making the entire circuit inoperable. As a result, an excellent display cannot be obtained, and a yield is lowered in the entire display device. Also, to obtain the reverse image, two kinds of driver circuits, having a driver circuit for the forward selection and a driver circuit for the backward selection, are required.

SUMMARY OF THE INVENTION

To improve the foregoing drawback, the inventors of the present invention conceived a decoder driver circuit which directly selects a display pixel portion in accordance with an address signal by replacing the shift register portion by a decoder circuit.

FIG. 3 is a circuit block diagram showing a decoder driver circuit of the digital system.

An address signal of a pixel to be displayed is input to an address decoder 301 from an external terminal, and a display pixel is selected as a binary digital signal in the address decoder 301.

The address signal constitutes a latch pulse 303 input to first latch circuits 302 connected in parallel to each other by the number corresponding to the number of bits of an image signal. The latch circuits 302 are comprised of a D-type (delay-type) flip flop circuit (D-F.F. circuit), respectively.

Data signals 304 for selecting a gradation are input to those latch circuits 302, and the gradation of image data to be displayed is selected at a timing of the latch pulse 303 output from the address decoder 301, and then stored in the latch circuits 302 as a logic.

In this situation, the selected signal is input in the first latch circuit 302 as an input signal of succeeding second latch circuits 305 connected in series to the first latch circuits 302. The second latch circuits 305 output signals synchronized with a scanning timing of one time of the display device in accordance with a latch pulse 306 provided from the external. The signals output from the second latch circuits 305 are input to a decoder 307 in a state where the gradation of the image data to be displayed is selected.

The outputs of the decoder 307 are input to the gates of analog switches 309 connected to gradation signals 308 prepared by resistance-dividing a potential corresponding to the gradation in advance, where a pixel to be displayed and its gradation are selected. The selected digital display data is transmitted to a pixel portion to be displayed through a signal line 310.

The decoder type driver circuit prevents one defective circuit from adversely affecting other components to obtain an excellent display state and is remarkably improved in its yield at the display device.

Also, the decoder type driver circuit is capable of lowering the consumption power because of the display driver circuit using a random access, with which the costs are expected to be low.

However, in the decoder type driver circuit, as the number of bits is increased, the number of input terminals is increased. Each input terminal is connected with an address signal line from the external. The input terminals occupy the large area of an upper surface of a substrate because they are connected to the address signal lines. As a result, if the number of input terminals are increased, an area for arranging the input terminals are increased. This causes an additional problem that this area prevents the display device from being miniaturized.

Further, in the driver circuit of the address decoder system, with the number of bits of the address signals to be increased, an increase in wirings and an increase in an area necessary for wiring are unavoidable. Also, since a voltage is applied to the address signal lines at random, there is the possibility that cross-talk occurs.

An object of the present invention is to provide a driver circuit of the address decoder system for eliminating the above problem and improving the yield of the display device.

Another object of the present invention is to provide a driver circuit of the address decoder system for eliminating the above problem and enabling the bidirectional scanning of scanning lines or signal lines without providing an additional driver circuit for scanning the scanning lines or signal lines backward.

Another object of the present invention is to provide a driver circuit of the address decoder system which remarkably reduces the number of terminals and facilitates miniaturization of the display device.

According to the present invention, there is provided a display device driver circuit which comprises a synchronous clock counter, an address decoder circuit which inputs an output of the synchronous clock counter as an address signal, and a plurality of signal lines or a plurality of scanning lines which are connected to the address decoder circuit.

According to the present invention, there is also provided a display device driver circuit which comprises a synchronous clock counter an address decoder circuit which inputs an output of the synchronous clock counter as an address signal, and a plurality of signal lines or a plurality of scanning lines which are connected to the address decoder circuit, wherein the synchronous clock counter comprises an up and down counter.

According to the present invention, there is further provided in a driver circuit for an active matrix type display device for performing multi-gradation display, a signal line driver circuit which comprises a synchronous clock counter, an address decoder circuit which inputs an output of the synchronous clock counter as an address signal, a gradation storing circuit for storing gradation data, a gradation synchronous circuit for synchronizing an output timing of the gradation data stored in the gradation storing circuit with a scanning timing of the display device, and a circuit for converting the gradation data synchronized by the gradation synchronous circuit into an analog gradation voltage.

According to the present invention, there is provided in a driver circuit for an active matrix type display device for performing multi-gradation display, a signal line driver circuit which comprises a synchronous clock counter, an address decoder circuit which inputs an output of the synchronous clock counter as an address signal, a gradation storing circuit for storing gradation data, a gradation synchronous circuit for synchronizing an output timing of the gradation data stored in the gradation storing circuit with a scanning timing of the display device, and a circuit for converting the gradation data synchronized by the gradation synchronous circuit into an analog gradation voltage, wherein the synchronous clock counter comprises an up and down counter.

According to the present invention, there is provided in a driver circuit for an active matrix type display device, a signal line driver circuit which comprises a synchronous clock counter, an address decoder circuit which inputs an output of the synchronous clock counter as an address signal, and an amplifier circuit for amplifying a signal output from the address decoder to output an amplified signal to a scanning line.

According to the present invention, there is provided in a driver circuit for an active matrix type display device, a signal line driver circuit which comprises a synchronous clock counter, an address decoder circuit which inputs an output of the synchronous clock counter as an address signal and an amplifier circuit for amplifying a signal output from the address decoder to output an amplified signal to a scanning line, wherein the synchronous clock counter comprises an up and down counter.

That is, according to the present invention, the selection of the signal lines or the scanning lines is conducted by the address decoder circuit, and an output of the synchronous clock counter is used as an address signal input to the address decoder circuit.

The synchronous counter includes JK-F.F. circuits connected in parallel to each other which receive a clock signal as an input signal and have the number of bits necessary for counting the signal lines or the scanning lines.

According to the present invention, the output of the synchronous counter to the clock signal is input to the address decoder circuit as an address signal. This structure enables line sequential scanning which uses no shift register, i.e., which is not of the delay signal transmission type.

In the display device driver circuit of the present invention, an input signal line to the driver circuit is only one for a clock pulse, and the number of input terminals can be remarkably reduced in comparison with a system in which the signal lines or the scanning lines are selected by the address decoder system. As a result, the device can be miniaturized.

Also, in the address decoder circuit, even if a defect occurs in a circuit connected to one signal line (or one scanning line), circuits connected to other signal lines (or scanning lines) are not adversely affected by the defective circuit. Accordingly, such a problem caused by the driver circuit using the shift register circuit that all the circuits downstream of the defective circuit, fail to display, can be prevented. As a result, a display device which performs an excellent display, can be obtained with an improved yield.

Further, in the driver circuit of the present invention, a direction of selecting the signal lines or the scanning lines can be readily changed to forward or backward by selecting whether the synchronous counter is operated at the rise of the clock signal (up-count) or at the fall thereof (down-count), and the bidirectional driving is enabled without an increase in number of drive circuits.

A counter is roughly classified into a non-synchronous counter and a synchronous counter. The non-synchronous counter is shown in FIG. 6.

The JK-F.F. circuits which receive the clock pulse CP 601 as an input signal are connected in series at n-stages by the number of bits necessary for counting the signal lines or the scanning lines. When the number of pixels in the horizontal direction is 500, i.e., the number of signal lines is 500, 9 bits are necessary for the input of the signal line driver circuit.

The input signal of the JK-F.F. circuit at the second stage or subsequent stages is an output signal of the JK-F.F. circuit at its preceding stage. For counting the input clock pulse, it is required that the JK-F.F. circuit at the first stage reverses a signal every time it receives one clock pulse, the JK-F.F. circuit at the second stage reverses the signal every time it receives two clock pulses, and the other JK-F.F. circuits hold the signal. For that reason, the JK-F.F. circuit at the first stage reverses the signal every time it receives the clock signal with high level signals to be input to the J and K input terminals thereof. Similarly, the J and K input terminals of the JK-F.F. circuit at the second or succeeding stages are held to a high level, and an output signal of the circuit rises at a timing when the input signal is changed from high (referred to as "H") to low (referred to as "L"). A waveform shown in FIG. 7 is obtained.

However, in the non-synchronous counter, since the count at the second or succeeding stages depends on the output signal of the circuit at the fore-stage, the storage of the transmission delay time is actually caused, which makes it difficult to conduct the high speed operation. In addition, hazard occurs with the delay of that signal. Accordingly, the non-synchronous counter is improper for the high clock frequency. For that reason, the synchronous counter is used in the present invention.

BRIEF DESCRIPTION OF THE DRAWINGS

FIG. 1 schematically shows an entire liquid crystal display device;

FIG. 2 shows a line sequential scanning driver circuit of the analog system;

DETAILED DESCRIPTION OF THE PREFERRED EMBODIMENTS

A description will now be given of an example of a liquid crystal display device of the active matrix type with the structure of the present invention.

In the liquid crystal display device of the present invention, having the structure shown in FIG. 1, a signal line driver circuit 101 and a scanning line driver circuit 102 are disposed, and the output signal of a synchronous counter forms an address signal which is input to the address decoder circuit.

A liquid crystal pixel portion 103 is located so that pixel electrodes and counter electrodes both arranged in the form of a matrix are opposed to each other through liquid crystal.

The drain electrode of a thin film transistor (TFT) constituting the switching element is connected to each pixel electrode. The source electrode of each TFT is connected with the signal line, and the gate electrode thereof is connected with the scanning line.

Figure 9:
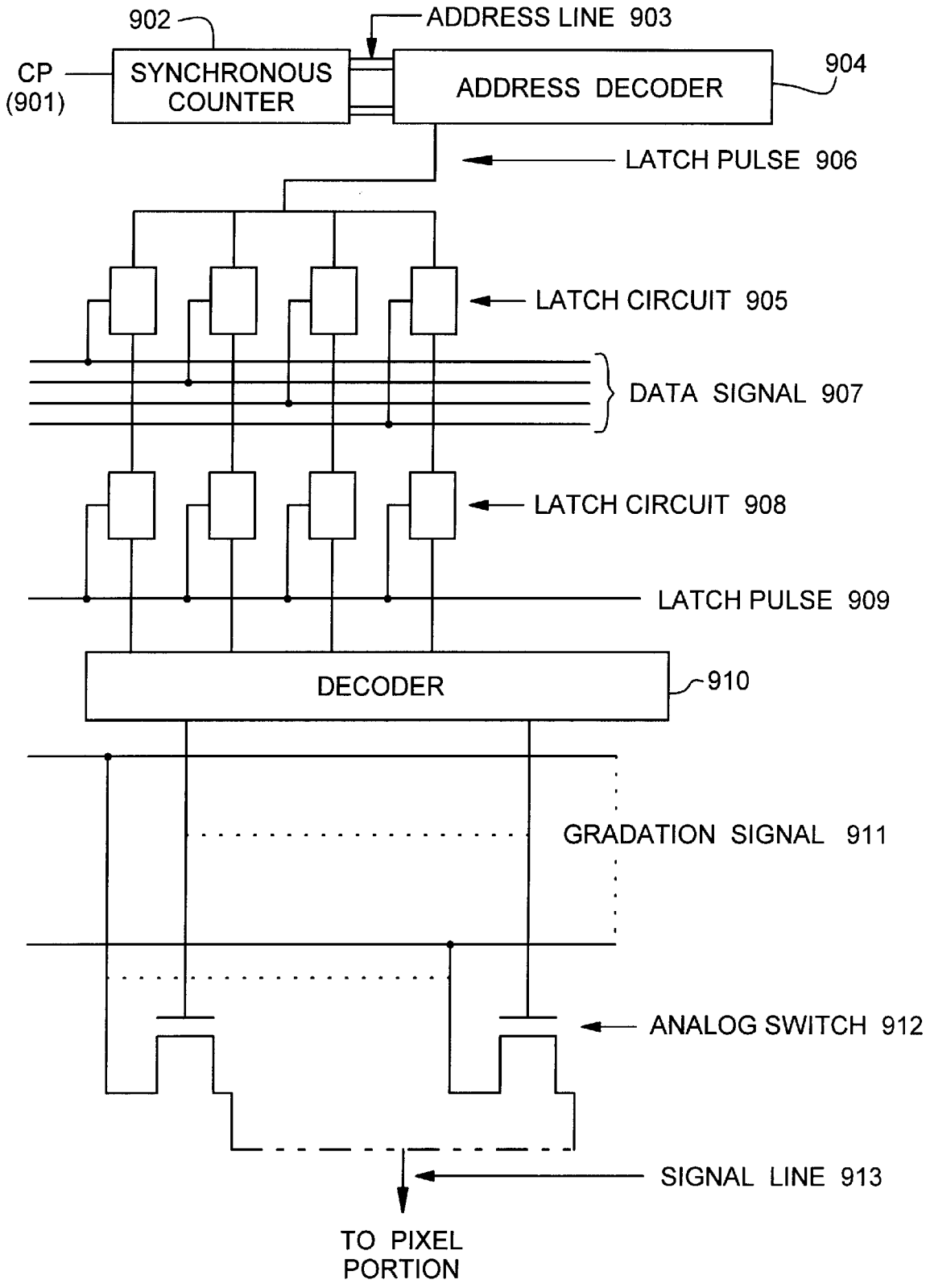
FIG. 9 shows a signal line driver circuit using a counter in an embodiment.

The signal line driver circuit of this embodiment is shown in FIG. 9. Here, a synchronous counter 902 will be described. The synchronous counter 902 does not taken an output signal of the circuit at a fore-stage as an input signal but provides a clock pulse to the respective stages as an input signal. Also, the synchronous counter 902 performs an accurate count without a time delay, which is a defect of the non-synchronous counter, by controlling the J and K inputs thereof.

Figure 8:
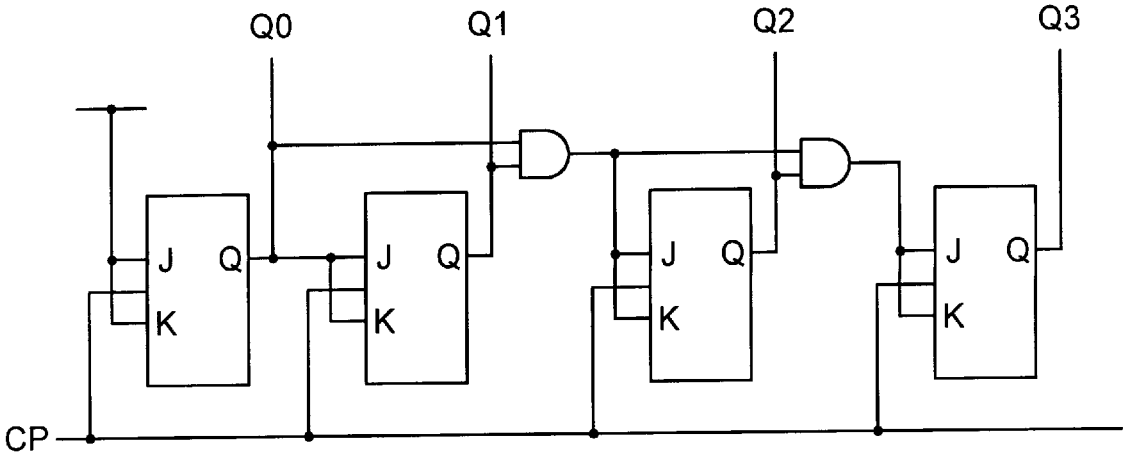
FIG. 8 shows the logic circuit of a synchronous counter.

In FIG. 8, the synchronous counter is comprised of JK-F.F. (flip flop) circuits which receive a clock pulse CP as an input signal, and are connected in parallel at n-stages by the number of bits necessary for counting the signal lines.

In this example, to conduct the monochrome display with the pixel structure of 500×500, 9 bits are necessary for the input of the signal line driver circuit. The clock pulse is input to the respective stages simultaneously.

The circuit operation will now be described below.

When the output signal of the circuit at a (Qn−1)-th stage is to be held at the output terminal of the circuit at a Qn-th stage, both of the J and K input terminals is set to be a low level (L) signal. When the output signal of the circuit at the (Qn−1)-th stage is to be forcedly reversed at the output terminal of the circuit at the Qn-th stage, both of the J and K input terminals must be set to a high level (H) signal.

Figure 7:
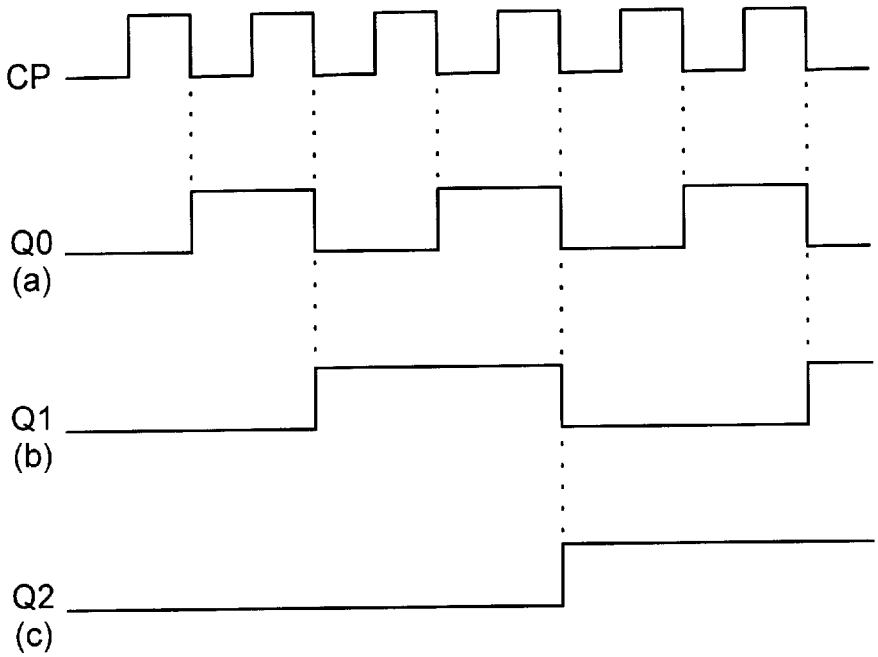
FIG. 7 shows an output waveform of a counter circuit.

For this reason, the J and K input terminals of the JK-F.F. circuit at the first stage are set to be the H signal so that the circuit reverses the signal every time it receives the clock signal. The output waveform is shown in (a) of FIG. 7.

It is required that the JK-F.F. circuit at the second stage reverses the signal every time it receives two clock pulses, and it hold the signal in other cases. Therefore, the output signal of the JK-F.F. circuit at the fore-stage is used as the J and K input signals. That is, a signal held by itself is reversed after the output signal of the circuit at the fore-stage is changed to the H signal without the J and K input terminals to be set to the H signal. The output waveform is shown in (b) of FIG. 7.

The J and K input terminals at the third or succeeding stages are controlled as follows: As is apparent from FIG. 7, the output of the Qn-th stage is reversed (J and K inputs are the H signal) when all of the Q0-th, Q1-th, . . . (Qn−1)-th stages are the H signal. Therefore, if the output signal of the AND circuit of the Q0-th, Q1-th, . . . (Qn−1)-th stages is an input signal of the J and K input terminals of the JK-F.F. circuit at the n-stage, when all of the Q0-th, Q1-th, . . . (Qn−1)-th stages are the H signal, then J and K inputs=the H signal, the output signal of the JK-F.F. circuit at the n-stage is reversed, and in other cases, a signal is held. The output waveform is shown in (c) of FIG. 7.

In the signal line driver circuit shown in FIG. 9, the clock pulse CP 901 is input to the synchronous counter 902 as an input signal. In this situation, the number of clocks counted is regarded as an address signal, and the address signal is input to an address decoder 904 through address lines 903, and a display pixel is selected as a binary digital signal.

Therefore, the address lines 903 does not exist upstream of the synchronous counter 902, and only one wiring for the clock pulse CP 901 is drawn out (extended) from the synchronous counter 902 to an external connection terminal.

The address signal forms a latch pulse 906 of first latch circuits 905 connected in parallel by the number corresponding to the number of bits of an image signal (gradation signal). The first latch circuits 905 are comprised of delay flip flop circuits (D-F.F. circuits).

The first latch circuits 905 receive data signals 907 supplying gradation data as an input signal. The first latch circuits 905 receive gradation signals representing the data signals 907 at a timing of the latch pulse 906 output from the address decoder 904, and then store the results inside thereof as a logic.

The selected signal is taken as an input signal of succeeding second latch circuits 908 which are connected in series with the first latch circuits 905. The second latch circuits 908 output a signal synchronized with the scanning timing of one time of the display device in accordance with a latch pulse 909 supplied from the external, and the output signal is input to a decoder 910 in a state where the gradation of the image data to be displayed is selected.

The output of the decoder 910 is input to the gate of an analog switch 912 corresponding to the input gradation data.

The analog switches 912 are connected to lines of gradation signals 911. The lines of the gradation signals 911 are prepared by resistance-dividing a voltage corresponding to the gradation.

The selected one of the gradation signals 911 is output to the pixel portion to be displayed through a signal line 913. If necessary, the gradation signals 911 may be amplified by an amplifying circuit (not shown) before they are output to the pixel portion.

Next, the bidirectional drive is described below.

In the bidirectional drive, an up and down counter is used which enables the selection as to whether the circuit is operated at the rise of the clock signal 910 or at the fall thereof.

Figure 10:
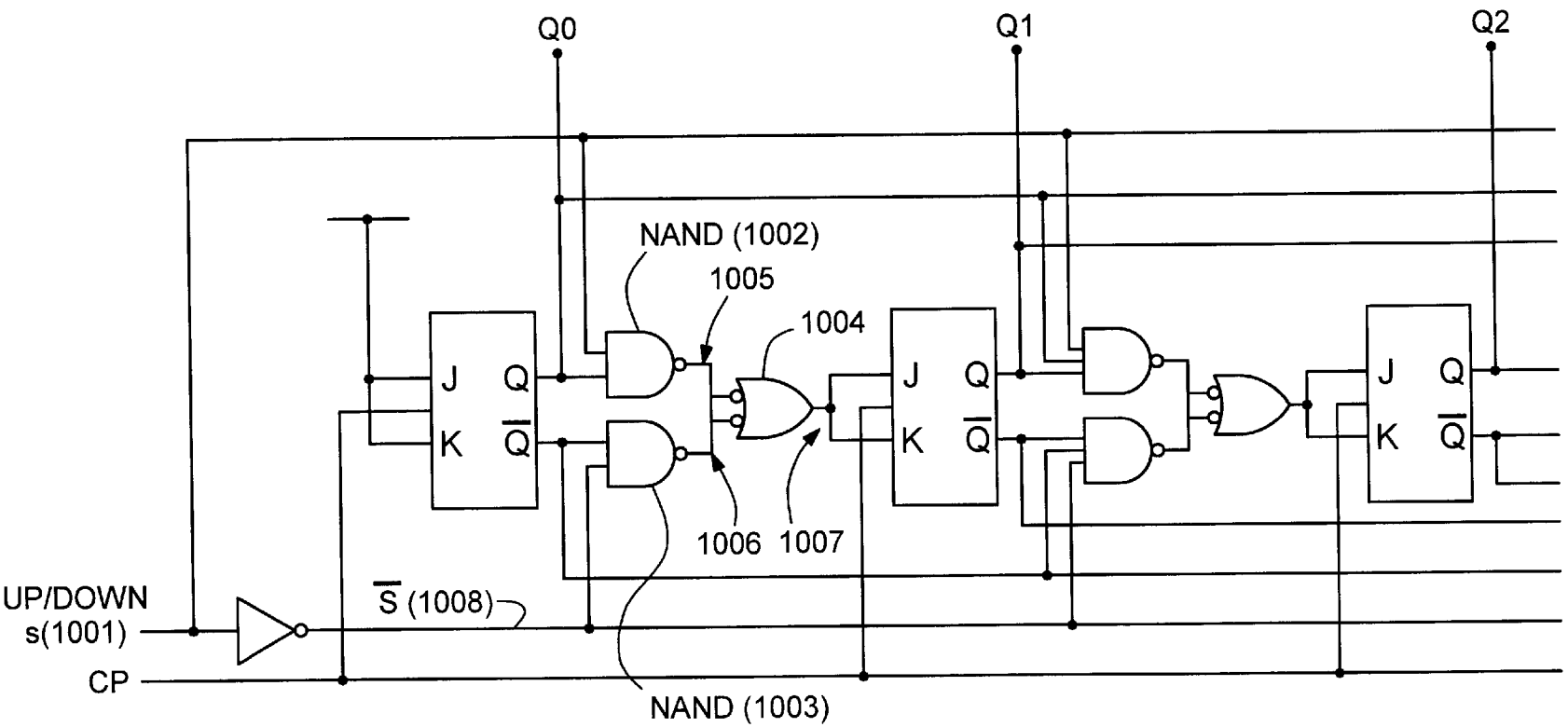
FIG. 10 shows the logic circuit of an up and down counter.

The logic circuit of the up and down counter is shown in FIG. 10. When H is input to an input terminal S 1001 of a switch for changing over the up counter and the down counter, the counter changes over to the up counter, and the circuit is operated at the fall of the clock. When L is input to the input terminal S 1001, the counter changes over to the down counter, and the circuit is operated at the rise of the clock.

The circuit operation of the up and down counter is described below. The J and K input terminals of the JK-F.F. circuit at the first stage are held to H so that the JK-F.F. circuit reverses a signal every time it receives a clock signal likewise as in the foregoing example.

The J and K input terminals of the JK-F.F. circuit at the second or succeeding stages receives a signal obtained by NANDing the up and down changing switch input S with Q0, Q1, . . . , Qn−1 by NAND circuit 1002 and NANDing a signal $\overline{S}$ 1008 obtained by inverting the switch input S with the $\overline{Q0}$, $\overline{Q1}$, . . . $\overline{Qn-1}$ by NAND circuit 1003, and then ORing those output signals by OR circuit 1004 through the invertor.

The circuit operation when the input S 1001 of the up and down changing switch is H is described below. In the JK-F.F. circuit at the second stage, the NAND output 1005 at the upstream stage is L when Qn−1=H, but H when Qn−1=L. In other words, since H is fixedly input as a changing signal, the output is changed in accordance with the level of Qn−1.

On the contrary, since the NAND output 1006 at the downstream stage has L as a hold signal, the output is H at all times regardless of the level of $\overline{Qn-1}$.

Therefore, a signal inputting the OR circuit through the invertor becomes H, L when Qn−1=H, and the output 1007 becomes H (Qn is a signal inversion). On the other hand, when Qn−1=L, that signal becomes L, L, and the output 1007 becomes L (Qn is a signal holding).

Figure 11:
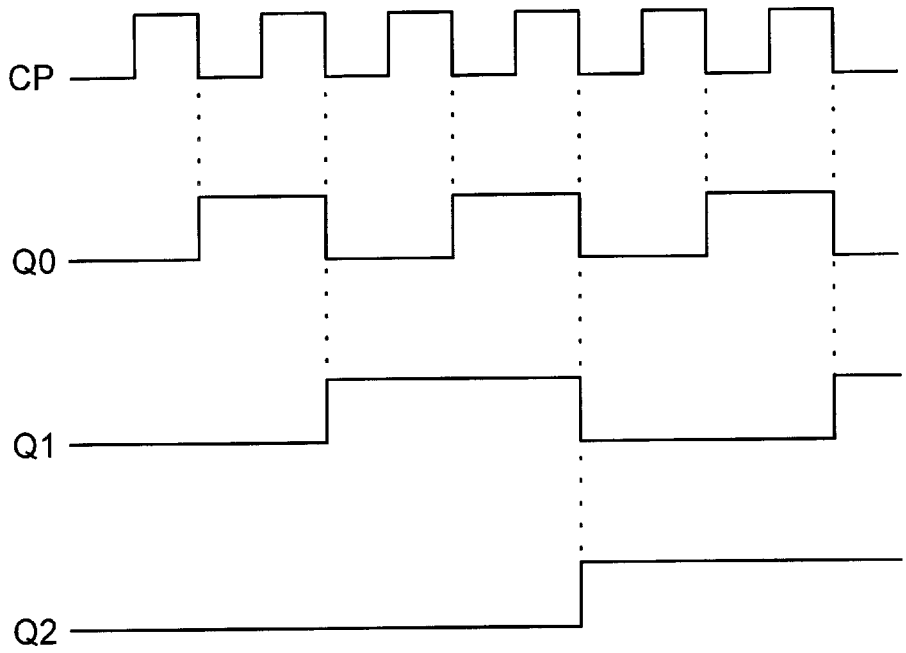
FIG. 11 shows an output waveform of the up counter.

The same circuit operation is conducted at the second and succeeding stages, and the output waveform is shown in FIG. 11. That is, when the input S of the up and down changing switch is H, the counter acts as the up counter. When all of the outputs Q0, Q1, . . . , Qn−1 are H, then J and K inputs become H, and the signal is reversed. If at least one of the outputs Q0, Q1, . . . , Qn−1 is L, then Qn becomes in a signal holding state.

The circuit operation when the input S of the up and down changing switch is L is described below. In the JK-F.F. circuit at the second stage, the NAND output 1005 at the upstream stage is H at all times not depending on the level of Qn−1 because L is input as a fixed signal.

On the contrary, the NAND output 1006 at the downstream stage has L when Qn−1=H, but H when Qn−1=L. In other words, since H is fixedly input as a reverse signal of the changing signal, the output is changed depending on the level of Qn−1.

Therefore, when Qn−1=H, a signal inputting the OR circuit through the invertor becomes L, L and the output 1007 becomes L (Qn is a signal holding). On the other hand, when Qn−1=L, that signal becomes H, L, and the output 1007 becomes H (Qn is a signal inversion).

Figure 12:
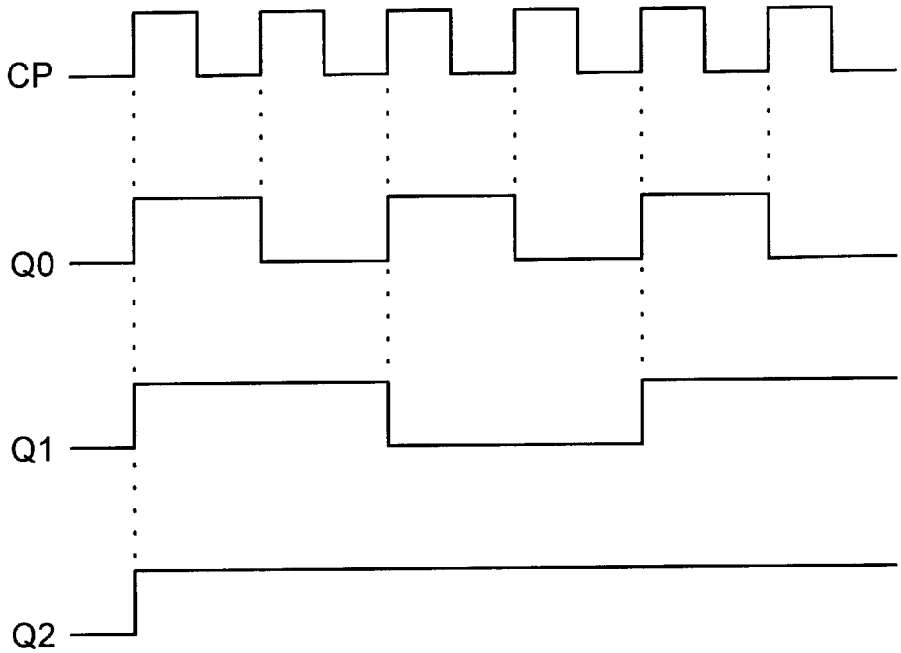
FIG. 12 shows an output waveform of the down counter.

The output waveform obtained in the same manner is shown in FIG. 12. In other words, when the input S of the up and down changing switch is L, the counter acts as the down counter. When all of the outputs Q0, Q1, . . . , Qn−1 are L, then J and K inputs become H and the signal of Qn is reversed. If at least one of the outputs Q0, Q1, . . . , Qn−1 is H, then Qn becomes in a signal holding state.

In this manner, the selection direction of the signal line can be extremely readily changed over by the up and down changing switch. For example, a direction of selecting the signal lines can be changed from a state where the direction is shifted from the left to the right to a state where the direction is shifted from the right to the left, thereby readily obtaining an image the right and left of which are reversed.

Figure 13:
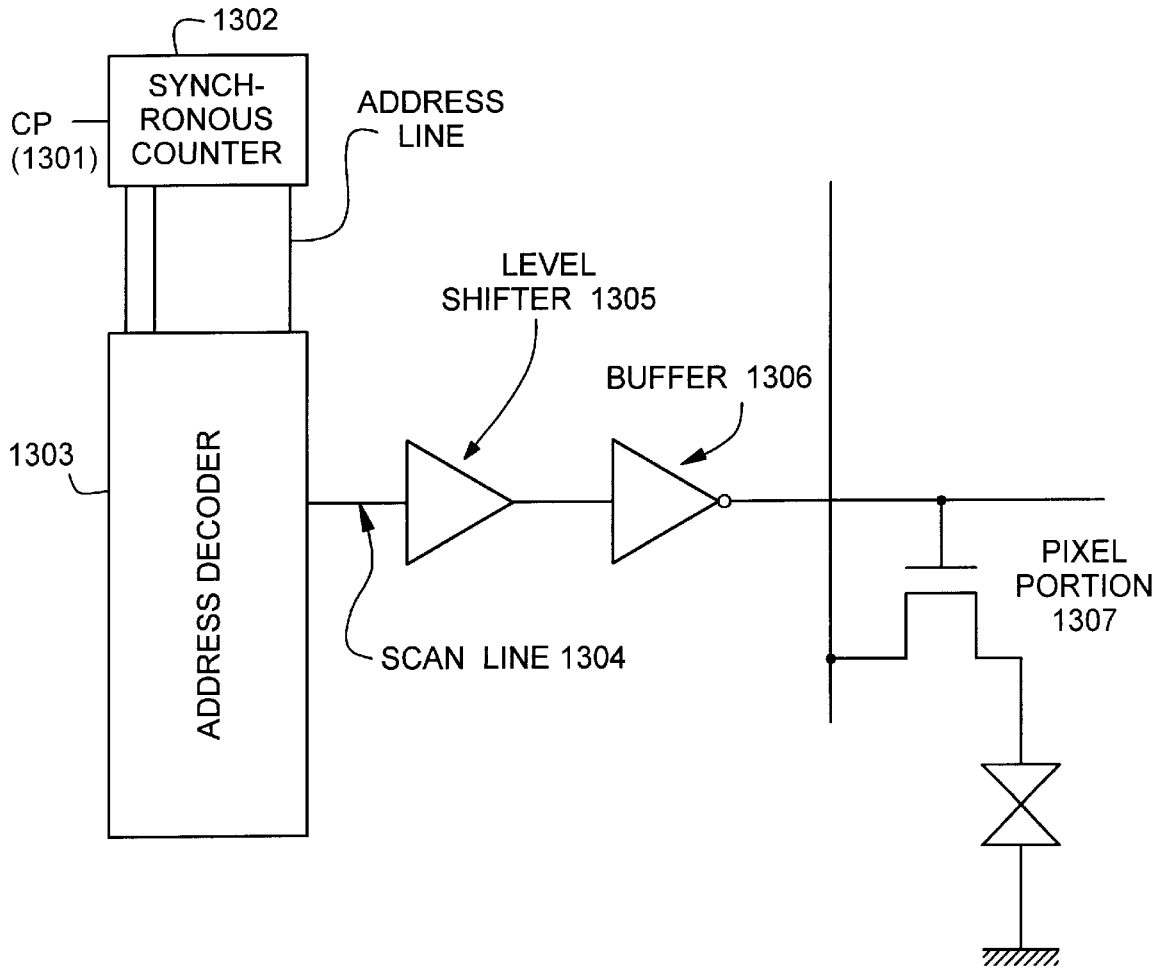
FIG. 13 shows a scanning line driver circuit using a counter in an embodiment.

Subsequently, the scanning line driver circuit in this embodiment is shown in FIG. 13. In this example, even in the scanning line driver circuit, the output of the synchronous clock counter is input to the address decoder circuit as an address signal.

In FIG. 13, the output of a synchronous counter 1302 which receives a clock pulse CP 1301 as an input signal is used as an address signal input to an address decoder 1303. An output of an address decoder 1303 is amplified by a level shifter 1305 and a buffer 1306 through a scanning line 1304 selected by the address designation of the address signal, and then transmitted to a pixel portion 1307 connected with the gate electrode of a thin film transistor of each pixel on one line.

In the scanning line driver circuit, with a synchronous clock counter provided as an up and down counter, the selection direction of the scanning lines can be changed. In this case, with such a changing, the upper and lower portions of the display image can be reversed.

The liquid crystal display device structured by the present invention as described above can obtain an excellent display state without any from defective signal line on the other signal lines, even though the defective signal line causes the impossibility of display.

Also, since there is no wiring of address signal lines but only a clock pulse wiring extended in the periphery of the circuit, no area where the address signal lines are connected is required, and the device can be miniaturized.

Figure 3:
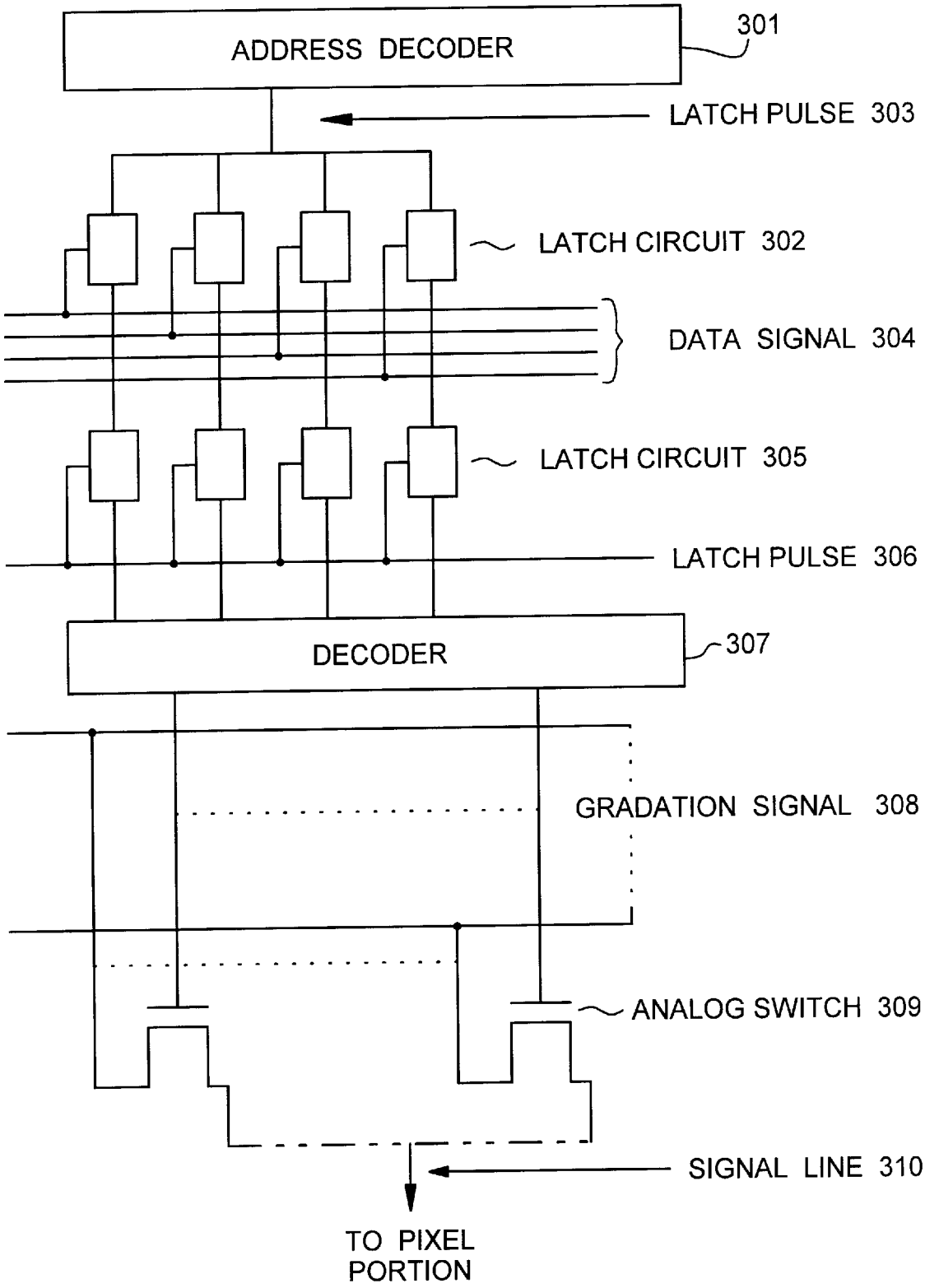
FIG. 3 shows a digital driver circuit using an address decoder.
Figure 4:
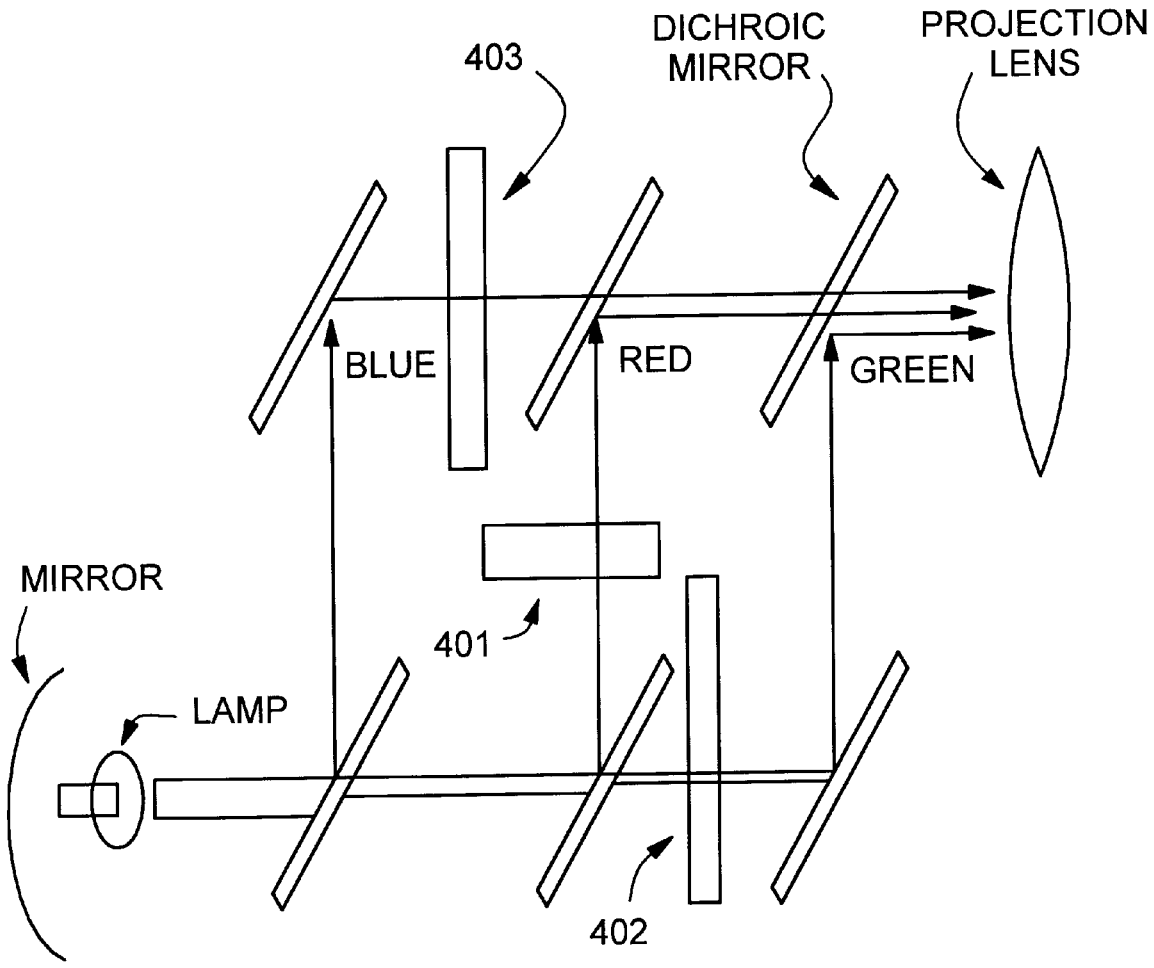
FIG. 4 shows the structure of a projection type display device of the three plate type.
Figure 5A:
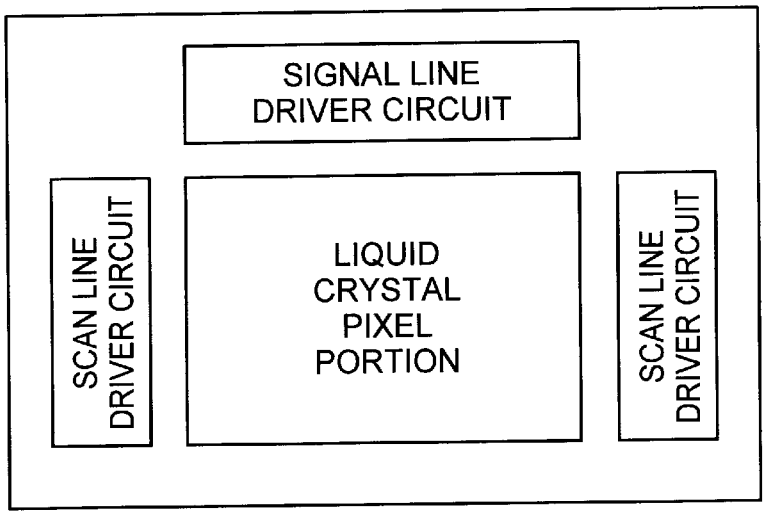
FIGS. 5A and 5B schematically shows a display device on which a bidirectional driver is mounted.
Figure 5B:
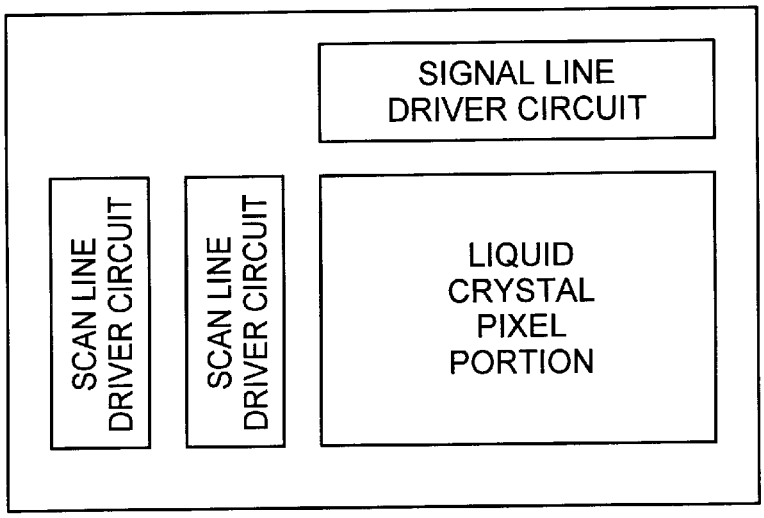
Figure 6:
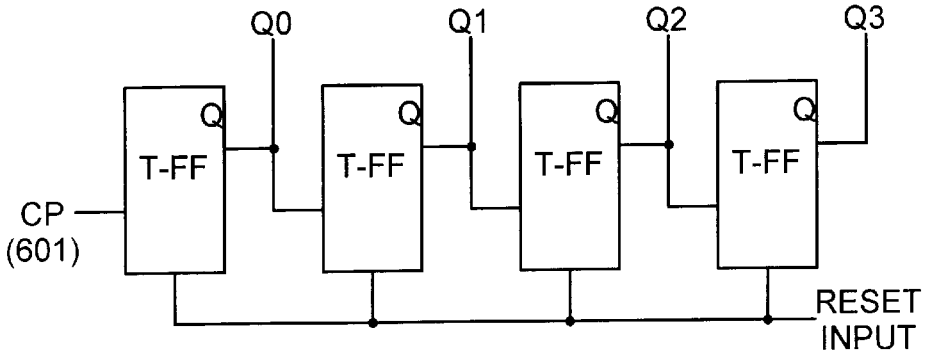
FIG. 6 shows the logic circuit of a non-synchronous counter.

Further, when three liquid crystal display devices of this type are used for the projection type display device shown in FIG. 4, the reverse display image and the non-reverse image can be obtained without providing an additional driver circuit by the display devices having the same structure. As a result, an excellent projection image can be obtained.

As described above, according to the present invention, the line sequential scanning (selection) is enabled instead of the line sequential scanning (selection) driver circuit of the delay signal transmission using the shift register.

For that reason, the defective circuit connected to one signal line (or scanning line) does not adversely affect the operation of the circuits at the post-stages, and an excellent display state can be obtained. As a result, the yield of the entire display device can be remarkably improved.

Also, the problems such as the increased size of the display device, which is caused by an increase in the number of external input terminals as a result of using the address decoder, and the occurrence of a cross-talk due to an increase in the number of input lines, can be solved by the application of the synchronous counter.

Compared with a case where an address value is directly supplied to the address decoder circuit for driving, because the number of wiring for address signal supply is one, that is remarkably reduced, the miniaturization of the device can be facilitated.

Also, in the clock counter circuit, the direction of selecting the signal lines or the scanning lines can be changed over by one driver circuit by selecting any one of the rise operation and the fall operation. This causes the design and the manufacturing process to be simplified, thereby being capable of realizing reduced costs. In particular, in the projection type display device, when the liquid crystal display device for displaying a reverse image and the liquid crystal display device for displaying a non-reverse image are required, reduced costs are facilitated.

Further, the driver circuit of the present invention can be used for any one of the signal line driver circuit and the scanning line driver circuit.

What is claimed is:

1. An active matrix display device comprising:

a plurality of pixels in matrix form, each pixel including a thin film transistor;

a plurality of signal lines and a plurality of scanning lines, both of said lines connected to corresponding thin film transistors, respectively;

at least one driver circuit being connected to either the signal lines or the scanning lines for driving the pixels, said driver circuit including:

a synchronous clock counter functioning as an up and down counter, said synchronous clock counter receiving a clock signal and an input of an up and down changing switch; and an address decoder circuit receiving output of the synchronous clock counter as address signals through address lines, wherein a direction of selecting the signal lines or the scanning lines by the address decoder circuit is changed by selecting whether the up and down counter is operated at a rise of the clock signal or at a fall thereof according to the input of the up and down changing switch, and wherein said address lines connect said address decoder circuit with only said synchronous clock counter.

2. A device according to claim 1 wherein the pixels, the signal and scanning lines, and the driver circuit including the synchronous clock counter and the address decoder are provided on a same substrate.

3. A device according to claim 1 wherein the display device includes an active matrix liquid crystal display device.

4. A device according to claim 1 wherein the address decoder circuit connects to either the signal lines or the scan lines and conducts selection of the connected lines using the address signals.

5. A device according to claim 1 wherein address lines do not exist upstream of the synchronous clock counter.

6. A device according to claim 1 wherein when said input of the up and down changing switch is High, the up and down counter changes over to an up counter and is operated at the fall of the clock signal.

7. A device according to claim 1 wherein when said input of the up and down changing switch is Low, the up and down counter changes over to a down counter and is operated at the rise of the clock signal.

8. An active matrix display device comprising:

a pixel circuit having a plurality of pixels in matrix form, each pixel including a thin film transistor;

a plurality of signal lines and a plurality of scanning lines, both of said lines connected to corresponding thin film transistors, respectively;

at least one driver circuit being connected to either the signal lines or the scanning lines for driving the pixel circuit, said driver circuit including:

a synchronous clock counter, said counter receiving a clock signal and an input of an up and down changing switch;

an address decoder circuit being connected to the synchronous clock counter through address lines and connected to either the signal lines or the scanning lines, wherein the address decoder circuit conducts a selection of the connected lines for switching the thin film transistor of the pixel to be displayed according to address signals generated from said synchronous clock counter, wherein the synchronous clock counter functions as an up and down counter for changing a direction of the selection of said lines and is operated at either a rise of the clock signal or at a fall thereof according to the input of the up and down changing switch, and wherein said address signal is the number of clocks counted by the synchronous clock counter.

9. A device according to claim 8 wherein the pixel circuit, the signal and scanning lines, and the driver circuit including the synchronous clock counter and the address decoder are provided on a same substrate.

10. A device according to claim 8 wherein the display device includes an active matrix liquid crystal display device.

11. A device according to claim 8 wherein the selection of the connected line is conducted using the address signal.

12. A device according to claim 8 wherein address lines do not exist upstream of the synchronous clock counter.

13. A device according to claim 8 wherein when said input of the up and down changing switch is High, the up and down counter changes over to an up counter and is operated at the fall of the clock signal.

14. A device according to claim 8 wherein when said input of the up and down changing switch is Low, the up and down counter changes over to a down counter and is operated at the rise of the clock signal.

15. An active matrix display device for performing a plurality of gradation displays, comprising:

a pixel circuit having a plurality of pixels in matrix form, each pixel including a thin film transistor;

a plurality of signal lines and a plurality of scanning lines, both of said lines connected to corresponding thin film transistors, respectively; and at least one signal line driver circuit, said signal line driver circuit comprising:

a synchronous clock counter functioning as an up and down counter, said synchronous clock counter receiving a clock signal and an input of an up and down changing switch;

an address decoder circuit connected to the synchronous clock counter through address lines for receiving output of the synchronous clock counter as address signals, a storage circuit for storing gradation data in accordance with an output of the address decoder circuit, a synchronizing circuit for synchronizing an output timing of the gradation data stored in the storage circuit with a display scan timing, and a converting circuit for converting the output gradation data into an analog gradation voltage, wherein a direction of selecting the signal lines by the address decoder circuit is changed by selecting whether the up and down counter is operated at a rise of the clock signal or at a fall thereof according to the input of the up and down changing switch, and wherein said address lines connect said address decoder circuit with only said synchronous clock circuit.

16. A device according to claim 15 wherein the signal lines are connected to the converting circuit.

17. A device according to claim 15 wherein the pixel circuit, the signal and scanning lines, and the signal line driver circuit including the synchronous clock counter, the address decoder, the store circuit, the synchronizing circuit, and the converting circuit are provided on a same substrate.

18. A device according to claim 15 wherein when said input of the up and down changing switch is High, the up and down counter changes over to an up counter and is operated at the fall of the clock signal.

19. A device according to claim 15 wherein when said input of the up and down changing switch is Low, the up and down counter changes over to a down counter and is operated at the rise of the clock signal.

20. A device according to claim 15 wherein any address lines do not exist upstream of the synchronous clock counter.

21. An active matrix display device for performing a plurality of gradation displays, comprising:

a pixel circuit having a plurality of pixels in matrix form, each pixel including a thin film transistor;

a plurality of signal lines and a plurality of scanning lines, both of said lines connected to corresponding thin film transistors, respectively; and at least one signal line driver circuit, the signal line driver circuit including:

a synchronous clock counter, said counter receiving a clock signal and an input of an up and down changing switch;

an address decoder connected to the synchronous clock counter through address lines for receiving output of the synchronous clock counter as address signals, a storage circuit for storing gradation data in accordance with output of the address decoder circuit, a synchronizing circuit for synchronizing an output timing of the gradation data stored in the storage circuit with a display scan timing, and a converting circuit for converting the output gradation data into an analog gradation voltage, wherein the synchronous clock counter functions as an up and down counter for changing a direction of a selection of the signal lines and is operated at either a rise of the clock signal or at a fall thereof according to the input of the up and down changing switch, and wherein said address signal is the number of clocks counted by the synchronous clock counter.

22. A device according to claim 21 wherein the signal lines are connected to the converting circuit.

23. A device according to claim 21 wherein the pixel circuit, the signal and scanning lines, and the signal line driver circuit including the synchronous clock counter, the address decoder, the store circuit, the synchronizing circuit, and the converting circuit are provided on a same substrate.

24. A device according to claim 21 wherein when said input of the up and down changing switch is High, the up and down counter changes over to an up counter and is operated at the fall of the clock signal.

25. A device according to claim 21 wherein when said input of the up and down changing switch is Low, the up and down counter changes over to a down counter and is operated at the rise of the clock signal.

26. A device according to claim 21 wherein any address lines do not exist upstream of the synchronous clock counter.

27. An active matrix display device comprising:

a pixel circuit comprising a plurality of pixels in matrix form, each pixel including a thin film transistor;

a plurality of signal lines and a plurality of scanning lines, both of said lines connected to corresponding thin film transistors, respectively; and at least one scanning line driver circuit, said scanning line driver circuit including:

a synchronous clock counter functioning as an up and down counter, said synchronous clock counter receiving a clock signal and an input of an up and down changing switch;

an address decoder circuit for receiving output of the synchronous clock counter as address signals through address lines; and a plurality of amplifier circuits for amplifying output of the address decoder circuit, the amplifier circuits being connected to the scanning lines, wherein a direction of a selection the scanning lines by the address decoder circuits is changed by selecting whether the up and down counter is operated at a rise of the clock signal or at a fall thereof according to the input of the up and down changing switch, and wherein said address lines connect said address decoder circuit with only said synchronous clock counter.

28. A device according to claim 27 wherein the address decoder circuit conducts a selection of the connected signal lines for switching the pixels to be displayed.

29. A device according to claim 27 wherein the address lines do not exist upstream of the synchronous clock counter.

30. A device according to claim 27 wherein when said input of the up and down changing switch is High, the up and down counter changes over to an up counter and is operated at the fall of the clock signal.

31. A device according to claim 27 wherein when said input of the up and down changing switch is Low, the up and down counter changes over to a down counter and is operated at the rise of the clock signal.

32. A device according to claim 27 wherein the pixel circuit, the signal and scanning lines, and the scanning line driver circuit including the synchronous clock counter, the address decoder, and the amplifier circuits are provided on a same substrate.

33. An active matrix display device comprising:

a pixel circuit having a plurality of pixels in matrix form, each pixel including a thin film transistor;

a plurality of signal lines and a plurality of scanning lines, both of said lines connected to corresponding thin film transistors, respectively; and at least one scanning line driver circuit, said scanning line driver circuit including:

a synchronous clock counter functioning as an up and down counter, said synchronous clock counter receiving a clock signal and an input of an up and down changing switch;

an address decoder circuit receiving output of the synchronous clock counter as address signals through address lines; and a plurality of amplifier circuits for amplifying output of the address decoder circuit, wherein the address decoder circuit conducts a selection of the scanning lines for switching the thin film transistors of the pixel to be displayed, wherein a direction of the selection of the lines is changed forward or backward in accordance with output of the up and down counter, wherein said synchronous clock counter is operated at either a rise of the clock signal or at a fall thereof according to the input of the up and down changing switch, and wherein said address signal is the number of clocks counted by the synchronous clock counter.

34. A device according to claim 33 wherein the pixel circuit, the signal and scanning lines, and the scanning line driver circuit including the synchronous clock counter, the address decoder, and the amplifier circuits are provided on a same substrate.

35. A device according to claim 33 wherein address lines do not exist upstream of the synchronous clock counter.

36. A device according to claim 33 wherein when said input of the up and down changing switch is High, the up and down counter changes over to an up counter and is operated at the fall of the clock signal.

37. A device according to claim 33 wherein when said input of the up and down changing switch is Low, the up and down counter changes over to a down counter and is operated at the rise of the clock signal.

* * * * *